US006117562A

United States Patent [19]

Yamaguchi et al.

[11] Patent Number: 6,117,562

[45] **Date of Patent: *Sep. 12, 2000**

[54] THERMAL IMAGE TRANSFER RECORDING MEDIUM

[75] Inventors: Junko Yamaguchi, Shimizu-machi; Mitsuru Maeda, Shizuoka-ken; Tetsuji Kunitake, Numazu; Kazuyoshi Inamura, Numazu; Yasumitsu Kuga, Numazu; Shigeru Miyajima, Fuji; Tadafumi Tatewaki, Numazu; Yoshiaki Yamada, Shizuoka-ken, all of Japan

[73] Assignee: Ricoh Company, Ltd., Tokyo, Japan

[ * ] Notice: This patent is subject to a terminal disclaimer.

[21] Appl. No.: 08/979,368

[22] Filed: Nov. 26, 1997

Related U.S. Application Data

[62] Division of application No. 08/572,115, Dec. 14, 1995, Pat. No. 5,716,477, which is a continuation of application No. 08/291,487, Aug. 17, 1994, abandoned.

[30] Foreign Application Priority Data

Aug. 17, 1993 [JP] Japan ..... 5-225195
Nov. 1, 1993 [JP] Japan ..... 5-296044

[51] Int. Cl.[7] ..... B41M 5/26

[52] U.S. Cl. ..... 428/532; 428/195

[58] Field of Search ..... 428/195, 207, 428/484, 488.4, 488.1, 537.5, 532, 913, 914

[56] References Cited

U.S. PATENT DOCUMENTS 4,707,395 11/1987 Ueyama et al. .
4,749,679 6/1988 Yoshida et al. .
4,777,079 10/1988 Nagamoto et al. .
4,965,132 10/1990 Mizobuchi et al. .
4,978,709 12/1990 Taniguchi et al. .
4,983,444 1/1991 Ide et al. .
4,983,446 1/1991 Taniguchi et al. .
5,045,383 9/1991 Maeda et al. .
5,053,267 10/1991 Ide et al. .
5,110,389 5/1992 Hiyoshi et al. .
5,182,160 1/1993 Kitamura et al. .
5,229,189 7/1993 Hiyoshi et al. .
5,248,543 9/1993 Taniguchi et al. .
5,248,561 9/1993 Fujiwara et al. ..... 428/488.1
5,250,346 10/1993 Nagai et al. .
5,250,361 10/1993 Ide et al. .
5,258,234 11/1993 Ide et al. .
5,716,477 2/1998 Yamaguchi et al. ..... 428/195

FOREIGN PATENT DOCUMENTS 62-94382 4/1987 Japan .
3-45387 2/1991 Japan .
4-83684 3/1992 Japan .

*Primary Examiner*—Pamela R. Schwartz
*Attorney, Agent, or Firm*—Oblon, Spivak, McClelland, Maier & Neustadt, P.C.

[57] ABSTRACT

A thermal image transfer recording sodium includes a support and a thermal image transfer ink layer formed on the support. The thermal image transfer ink layer contains a coloring agent, a resin with a melting point of 120° C. or more and an SP value of 10.5 to 12.5, and a melt viscosity lowering material for lowering the melt viscosity of the resin, with the compatibility of the resin and the malt viscosity lowering material, measured by a transparency measurement method, being 0.20 or less, or with the melt viscosity at 150° C. of the thermal image transfer ink layer being in the range of $1\times10^2$ to $5\times10^6$ poise.

8 Claims, No Drawings

THERMAL IMAGE TRANSFER RECORDING MEDIUM

This is a Division of application Ser. No. 08/572,115, filed on Dec. 14. 1995, now U.S. Pat. No. 5,716,477, allowed, which is a continuation of application Ser. No. 08/291,487, filed on Aug. 17, 1994, abandoned.

BACKGROUND OF THE INVENTION

1. Field of the Invention

The present invention relates to a thermal image transfer recording medium, in particular, a thermal image transfer recording medium for clothing items, and to a recording method by using the thermal image transfer recording medium.

2. Discussion of Background

Thermal image transfer recording media for clothing items are used for thermally recording information about the handling of clothing items on image receiving materials such as labels or the like.

Since such thermal image receiving materials are used by being attached on clothing items by sewing, it is required that images formed on the image receiving materials be neither washed off nor peeled off during washing and ironing.

Many thermal image transfer recording media for clothing items have been proposed. In particular, varieties of resins for use in a thermal image transfer ink layer of such thermal image transfer recording media have been investigated for the purpose of developing such an ink layer that is not peeled off the image receiving material during the course of laundering, when the ink layer is thermally transferred imagewise to the image receiving material.

As one kind of such resins, cellulose derivatives are conventionally known as resins to be contained in a thermal image transfer ink layer.

Por instance, Japanese Laid-Open Patent Application 47-11215 discloses a thermal image transfer ink composition comprising a cellulose derivative, a thermoplastic resin, a plasticizer and a sensitizer, which is coated in the form of an ink layer on a base material; Japanese Laid-Open Patent Application 63-34182 discloses a thermal image transfer ink layer which comprises a thermofusible material and a cellulose-based resin; Japanese Laid-Open Patent Application 1-133784 discloses a thermal image transfer ink layer which comprises a resin and at least one component selected from the group consisting of a cellulose fatty acid ester, vinyl chloride and vinylidene chloride; Japanese Laid-Open Patent Application 2-229072 discloses a thermal image transfer ink layer which comprises polyamide resin, nitrocellulose resin, carnauba wax, and a coloring pigment; and Japanese Laid-Open Patent Application 3- 192170 discloses an ink layer composition for coating, which comprises a coloring agent, a binder comprising ethyl cellulose, a thickening agent and a solvent.

Images formed by the above-mentioned thermal image transfer ink layers comprise ink components which are soluble in cleaning solvents such as water, warm water, 1,1,1-trichloroethane, perchlene and naphtha, so that such images do not have sufficiently high laundering resistance for use in practice.

Under such circumstances, the inventors of the present invention have previously proposed in Japanese Patent Application 05-60984 a thermal image transfer recording medium which comprises a support, and a release layer comprising a wax component, an undercoat layer comprising a resin component, and a thermal image transfer ink layer which are successively overlaid on the support, wherein at least one of the undercoat layer or the ink layer comprises a cellulose derivative as a binder resin, whereby not only the laundering resistance of images formed on an image receiving material, but also the thermosensitivity of the thermal image transfer recording medium at thermal image transfer recording can be improved.

However, when thermally transferred images are formed on varieties of image receiving materials, for example, films such as polyethylene film, polypropylene film, polyester film, acetate film and nylon film, cloth, and paper, by use of the above-mentioned thermal image transfer recording medium, not all the image receiving materials exhibit excellent adhesiveness to the thermally transferred images from the thermal image transfer recording medium, and as a matter of course, the anti-friction performance of the thermally transferred images (i.e. the performance that thermally transferred images are not peeled off the image receiving material when the thermal transferred images are frictioned) is insufficient for use in practice. Furthermore, the heat resistance of the images which are thermally transferred to such image receiving materials is also insufficient for use in practice.

SUMMARY OF THE INVENTION

It is therefore a first object of the present invention to provide a thermal image transfer recording medium which is capable of forming clear, thermally transferred images with high thermosensitivity on varieties of image receiving materials such as varieties of cloths made of fibers, plastic films and paper, with the thermal transferred images having excellent adhesiveness to such varieties of image receiving materials and excellent anti-friction performance.

A second object of the present invention is to provide a thermal image transfer recording medium which is capable of forming thermal transferred images on varieties of image receiving materials, which thermally transferred images have excellent laundering resistance and heat resistance, free from the problems that the thermally transferred images are peeled off the image receiving materials and spread when washed or cleaned together with the clothing items which bear the transferred images on the image receiving materials attached thereto by use of cleaning solvents and that the thermally transferred images are melted and peeled off the image receiving materials, or spread, when ironed.

A third object of the present invention is to provide a thermal image transfer recording medium which is free from blooming phenomenon.

The above-mentioned objects of the present invention can be achieved by a thermal image transfer recording medium which comprises a support, and a thermal image transfer ink layer formed on the support, the thermal image transfer ink layer comprising a coloring agent, a resin with a melting point of 120° C. or more and an SP value of 10.5 to 12.5, and a melt viscosity lowering material for lowering the melt viscosity of the resin, with the compatibility of the resin and the melt viscosity lowering agent, measured by a transparency measurement method, being 0.20 or less.

Alternatively, the above objects of the present invention can be achieved by a thermal transfer recording medium which comprises a support, and a thermal image transfer ink layer formed on the support, the thermal image transfer ink layer comprising a coloring agent, a resin with a malting point of 120° C. or more and an SP value of 10.5 to 12.5, and a melt viscosity lowering material for lowering the melt viscosity of the resin, with the melt viscosity at 150° C. of the thermal image transfer ink layer being in the range of $1\times10^2$ to $5\times10^6$ poise.

DESCRIPTION OF THE PREFERRED EMBODIMENTS

The present invention is based on the discovery that a thermal image transfer ink composition which comprises a coloring agent, a resin with a malting point of 120° C. or more and an SP (solubility parameter) value of 10.5 to 12.5, and a melt viscosity lowering material for lowering the melt viscosity of the resin, when used in the form of a thermal image transfer ink layer, is capable of performing thermal image transfer with high thermosensitivity and forming images with high resolution, since the thermal image transfer ink composition can be melted sharply at high temperature, and the shearing stress of the ink layer is small, and that this thermal image transfer Ink composition is also capable of forming transferred images with high adhesiveness to a variety of image receiving materials because the SP value of the resin is close to the SP values of the imago receiving materials, and therefore capable of forming transferred images with high anti-friction performance.

It is required that the resin with an SP value of 10.5 to 12.5 have good compatibility with the melt viscosity lowering material, and therefore, it is preferable that the compatibility thereof, measured by a transparency measurement method, be 0.20 or less.

This transparency measurement method is conducted by preparing a solution of a mixture of the above resin end the malt viscosity lowering material, forming a film with a thickness of 5 $\mu$m and measuring the transmission density of the film by use of a commercially available transmission densitometer, Macbeth TD904. The smaller the measured value, the higher the transmission# and the better the compatibility.

By increasing the compatibility of the resin and the melt viscosity lowering material, the melt viscosity of the ink layer can be uniformly lowered, and therefore the ink layer can efficiently penetrate Into the image receiving materials during the course of image transfer, so that the laundering resistance and heat resistance of the transferred images can be improved.

Furthermore, a thermal image transfer ink composition comprising a coloring agent, a resin with a melting point of 120° C. or more and an SP value of 10.5 to 12.5, and a melt viscosity lowering material for lowering the malt viscosity of the resin, when used in the form of a thermal image transfer ink layer with the malt viscosity at 150° C. thereof adjusted to the range of $1\times10^2$ to $5\times10^6$ poise, is capable of performing thermal image transfer with high thermosensitivity and forming images with high resolution, and also capable of forming transferred images with high adhesiveness to image receiving materials and therefore capable of forming transferred images with high anti-friction performance, and excellent laundering resistance and heat resistance. Therefore, transferred images which are not peeled off the image receiving materials and do not spread, even when ironed, can be formed on the image receiving materials.

When the melt viscosity at 150° C. of the thermal image transfer ink layer is larger than $5\times10^6$ poise, the thermosensitivity of the thermal image transfer ink layer is lowered, while when the melt viscosity at 150° C. of the thermal image transfer ink layer is smaller than $1\times10^2$ poise, transferred images tend to spread and the ironing resistance thereof is lowered.

Examples of the resin with a malting point of 120° C. and an SP value of 10.5 to 12.5 for use in the thermal image transfer ink layer include polymethyl methacrylate, epoxy resin, polyvinyl butyral, polyester, nitrocellulose, polyvinyl chloride, vinyl chloride-vinyl acetate copolymer, styrene-acrylonitrile copolymer, styrene-methyl methacrylate copolymer, methyl methacrylate-acrylonitrile copolymer, and polycarbonate. The resins for use in the thermal image transfer ink layer are not limited to these resins, but any resins produced by copolymerization so as to have the above-mentioned melting point and the SP value in the above-mentioned respective ranges can also be employed.

The SP value can be calculated in accordance with the following formula:

$$\delta = \left(\frac{\Delta E}{V}\right)^{\frac{1}{2}} = \left(\frac{\sum_i \Delta e_i}{\sum_i \Delta v_i}\right)$$

$\Delta E$: Cohesive energy density, $V$: Molar volume, $\Delta e_i$: Vaporization energy of atoms or atomic groups, and $\Delta v_i$: Molar volume.

The details of the calculation of the SP value are described, for instance, "Basic Science of Coating" by Yuji HARASAKI, published by Maki Shoten Co., Ltd.

Of the above-mentioned resins, nitrocellulose is particularly preferable for use in the thermal image transfer ink layer for the present invention.

As commercially available nitrocellulose, for example, RS type and SS type made by Daicel Chemical Industries, Ltd.; and HIG type, LIG type, SL-1 type and VX-1 type made by Asahi Chemical Industry Co., Ltd. can be employed. Of these commercially available nitrocelluloses, nirocelluloses (solid component: 25%) with a viscosity of 5.9 sec or less, measured in accordance with Japanese Industrial Standards (JIS) K-6703, are preferable in view of the thermosensitivity thereof.

Specific examples of the melt viscosity lowering material for use in the present invention include: waxes such as carnauba wax, oxidized polyethylene wax, candelilla wax and rice wax; plasticizers such as phthalic acid derivatives, fatty acid derivatives, phenol derivatives, trimellitic acid derivatives, sulfonic acid derivatives, phosphoric acid derivatives, glycol derivatives, paraffin derivatives, epoxy derivatives, adipic acid based polyester, low-molecular-weight polyethylene, and butyl carbamate; epoxy resins such as bisphenol S type, bisphenol A type, bisphenol F type, o-cresol novolak type, brominated phenolic novolak type, polyfunctional type, type, and alicyclic type; branched polyester; polyols; camphor; stearic acid; and Bisphenol A.

Of the above-mentioned malt viscosity lowering materials, phthalic acid derivative based plasticisers such as DMP, DBP, dioctyl phthalate, diisononyl phthalate, and diphenyl phthalate; sulfonic acid derivative based plasticizers as shown in the following TABLE 1; epoxy derivative based plasticizers such as epoxidized soybean oil, epoxidized linseed oil, alkyl epoxy stearate, and epoxidized fatty acid esters; glycol derivative based plasticizers much as polyethylene glycol; and phosphoric acid derivative based plasticizers such as trioctyl phosphate, triphenyl phosphate, tricresyl phosphate, cresyl diphenyl phosphate, and xylenyl diphenyl phosphate.

TABLE 1

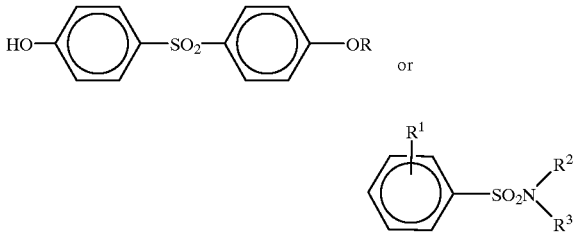

| R | $R^1$ | $R^2$ | $R^3$ | m.p. (° C.) |
|---|---|---|---|---|
| $CH_3$—CH—$CH_3$ | — | — | | 130 |
| — | p-$CH_3$ | $C_2H_5$ | H | 62–64 |
| — | p-$CH_3$ | $CH_3$ | $CH_3$ | 80–81 |
| — | p-$CH_3$ | H | H | 110–120 |
| — | o-$CH_3$ | | H | 86–88 |
| — | o-$CH_3$ | iso-$C_3H_7$ | H | 85–86 |
| — | o-$CH_3$ | | H | 98–100 |
| — | o-$CH_3$ | H | H | 135–137 |
| — | o-$CH_3$ | $C_2H_5$ | H | Liquid |
| — | o-$CH_3$ | $CH_3$ | H | 57–68 |
| — | o-$CH_3$ | H | H | 107–110 |
| — | o-$CH_3$ | H | H | 150 |

Of the above-mentioned melt viscosity lowering materials, the sulfonic acid derivative based plasticizers, which are crystalline low-molecular-weight materials, are preferable for obtaining images with improved resolution.

By use of such crystalline low-molecular-weight materials as the melt viscosity lowering materials, the shearing stress of the thermal image transfer ink layer can be decreased, so that the resolution of images to be obtained can be improved.

However, when only such a crystalline low-molecular-weight material is used in the thermal image transfer ink layer, there is the case where a blooming phenomenon takes place in the ink layer of the thermal image transfer recording medium with time. The blooming phenomenon is such a phenomenon that when a crystalline low-molecular-weight material is used in the ink layer, the crystals in the ink layer are uniform and grow with time to become large crystals, so that the crystalline low-molecular-weight material is separated out in the form of white fine particles on the surface of the ink layer.

When such a blooming phenomenon takes place in the ink layer, and the thermal image transfer recording medium is formed into a ribbon roll, the separated white particles of the crystalline low-molecular-weight material adhere to the back side of the thermal image transfer recording medium, and become thermal head dust when thermal printing is performed by use of a thermal head, and have adverse effects on the printing operation.

For the prevention of the blooming phenomenon, a crystallization preventing agent is useful. There is no particular limitation to such a crystallization preventing agent for use in the present invention as long as the crystallization prevent agent is capable of converting a crystalline state to an amorphous, state. As much a crystallization preventing agent, an agent having good compatibility with the above-mentioned crystalline low-molecular-weight material is preferable. Examples of such a crystallization preventing agent include the previously mentioned resins and plasticizers.

A crystallization preventing agent which is an isomer of the crystalline low-molecular-weight material is highly effective for preventing the blooming phenomenon because such a crystallization preventing agent has excellent compatibility with the crystalline low-molecular-weight material, and is capable of changing the crystalline state of the crystalline low-molecular-weight material to a uniform, amorphous state.

It is preferable that the ratio by weight of the crystalline low-molecular-weight material to the crystallization preventing agent be 95/5 to 70/30 in order to obtain a sufficient blooming phenomenon preventing effect.

Furthermore, as the melt viscosity lowering material for use in the present invention, it is preferable to employ a low-molecular-weight material with a melting point of 80 to 200° C. and a molecular weight of 1,000 or less. Examples of such a low-molecular-weight material for use as the melt viscosity lowering material include phenol derivatives, naphthol derivatives, organic acids, salts and esters thereof, amides, alcohols, others, ketones, aromatic amine derivatives, biphenyl derivatives, triphenylmethane derivative., phenanthrene derivatives, fluorene derivatives, anthracene derivatives, and carbazole derivatives.

Specific examples of the above-mentioned compounds are as follows: 4-tort-butylphenol (98), 4-hydroxydiphenyl ether (84), 1-naphthol (98), 2-naphthol (121), 4-hydroxyacetophenone (109), 2,2'-dihydroxydiphenyl ether (79), 4-phenylphenol (166), 4-tert-octylcatechol (109), 2,2'-dihydroxydiphenyl (103), 4,4'-methylene bisphenol (160), 2,2'-methylenebis(4-chlorophenol) (164), 2,2'-methylenebis(4-methyl-6-tert-butylphenol (125), 4,4'-isopropylidene diphenol (156), 4,4'-isopropylidenebis(2-chlorophenol) (90), 4,4'-isopropylidenebis(2,6-dibromophenol) (172), 4,4'-isopropylidenebis(2-tort-butylphenol) (110), 4,4'-isopropylidenebis(2-methylphenol) (136), 4,4'-isopropylidenebis(2,6-dimethylphenol) (168), 4,4'-sec-butylidenediphenol (119), 4,4-sec-butylidenebis(2-methylphenol) (142), 4,4'-cyclohexylidenediphenol (180), 4,4'-cyclohexylidenebis(2-methylphenol) (184), salicylic acid (163), methatolyl salicylate (74), phenacyl salicylate (110), methyl 4-hydroxybenzoate (131), ethyl 4-hydroxybenzoate (116), propyl 4-hydroxybenzoate (98), isopropyl 4-hydroxybenzoate (86), butyl 4-hydroxybenzoate (71), isoamyl 4-hydroxybenzoate (50), phenyl 4-hydroxybenzoate (178), benzyl 4-hydroxybenzoate (111), cyclohexyl 4-hydroxybenzoate (119), 5-hydroxysalicylic acid (200), 5-chlorosalicylic acid (172), 3-chloro-salicylic acid (178), thiosalicylic acid (164), 2-chloro-5-nitrobenzoic acid (165), 4-methoxyphenol (53), 2-hydroxybenzyl alcohol (87), 2,5-dimethylphenol (75), benzoic aicd (122), orthotoluic acid (107), methatoluic acid (111), paratoluic acid (181), orthochlorobenzoic acid (142), methaoxybenzoic acid (200), 2,4-dihydroxyacetophenone (97), resorcinol monobenzoate (135), 4-hydroxybenzophenone (133), 2,4-dihydroxybenzophenone (144), 2-naphthoic acid (184), 1-hydroxy-2-naphthoic acid (195), ethyl 3,4-dihydroxybenzoate (129), phenyl 3,4-dihydroxybenzoate (189), 4-hydroxypropiophenone (150), salicyl salicylate (148), monobenzyl phthalate (107), decyl acetamide, decyl propionamide, undecyl acetamide, undecyl propionamide, lauryl acetamide, lauryl propionamide, tridecyl acetamide, tridecyl propionamide, myristyl acetamide, myristyl propionamide, pentadecyl acetamide, pentadecyl propionamide, palmityl acetamide, palmityl propionamide, palmityl butylamide, heptyl acetamide, heptyl propionamide, stearyl acetamide, stearyl propionamide, stearyl butylamide, stearyl valeramide, stearyl capronamide, stearyl lauramide, stearyl palmitamide, stearyl stearamide, nonadecyl acetamide, nonadecyl propionamide, behenyl acetamide, behenyl propionamide, behenyl stearamide, N-methyl-undecanamide, N-ethylundecanamide, N-methyllauramide, N-ethyllauramide, N-methyltridecanamide, N-ethyltridecanamide, N-methylmyristamide, N-ethylmyristamide, N-methylpentadecanamide, N-ethylpentadecanamide, N-methylpalmitamide, N-dimethylpalmitamide, N-butylpalmitamide, N-methylstearamide, N-ethylstearamide, N-propylstearamide, N-butylstearamide, N-dimethylstearamide, N-diethylstearamide, N-dibutylstearamide, N-methylnonadecanamide, N-ethylnonadecanamide, N-methylbehenamide, N-methyloleamide, N-ethyloleamide, N-stearylbenzamide, N-palmityl-2-chlorobenzamide, N-stearyl-2-methoxybenzamide, N-stearyl-4-methylbenzamide, N-palmityl-2,4-dimethylbenzamide, N-behenylbenzamide, N-behenyl-2-methylbenzamide, N-stearylphenylacetylamide, N-behenylphenylacetylamide, N-cyclohexylacetamide, N-cyclohexylpropionamide, N-cyclohexylstearamide, N-cyclohoxylbenzamide, N-cyclohexyl-2-methylbenzamide, N-cyclohexyl-2-chlorobenzamide, N-cyclohexyl-2,4-dimethylbenzamide, N-cyclohexylpalmitamide, N-(2-chlorohexyl)palmitamide, N-(2-methylcyclohexyl)-stearamide, N-stearylhexahydrobenzamide, toluenesulfonamide, 2-methoxyphenyl 4-hydroxybenzoate, 2-methoxy-4-methylphenyl 4-hydroxybenzoate, 3,5-dioxyphenyl 4-hydroxybenzoate, 4-carboxyphenyl 3-hydroxybenzoate, 4-butoxyphenyl 4-hydroxybenzoate, 4-chlorophenyl 4-hydroxybenzoate, 2-chlorophenyl salicylate, 4-chlorophenyl salicylate, 2,4-dichlorophenyl salicylate, 2,6-dichlorophenyl salicylate, 2,4,6-trichlorophenyl salicylate, 2-bromophenyl salicylate, 4-bromophenyl salicylate, 2,4-dibromophenyl salicylate, 2,6-dibromophenyl salicylate, 2,4,6-tribromophenyl salicylate, 3-methylphenyl salicylate, 2,4-dimethylphenyl salicylate, 4-t-butylphenyl salicylate, 4-t-amylphenyl salicylate, 2-methoxyphenyl salicylate, 2-ethoxyphenyl salicylate, 3-methoxyphenyl salicylate, 4-hydroxyphenyl salicylate, 4-benzylphenyl salicylate, 4-benzoylphenyl salicylate, 2-methoxy-4-allylphenyl salicylate, α-naphtyl salicylate, β-naphthyl salicylate, 4-chloro-3-methylphenyl salicylate, 3-hydroxyphenyl salicylate, 4-propenylphenyl salicylate, 3-methylphenyl 5-chlorosalicylate, 2-methoxyphenyl 3,5-dichlorosalicylate, phenyl benzoate, 4-methylphenyl benzoate, 2,4-dichlorophenyl benzoate, 2,4,6-trichlorophenyl benzoate, 2-methyl-4-chlorophenyl benzoate, 3-bromophenyl benzoate, 2,4-dibromephenyl benzoate, 3-iodophenyl benzoate, 3-nitrophenyl benzoate, 4-methyl-2,6-dichlorophenyl benzoate, 4-isopropylphenyl benzoate, 4-t-butylphenyl benzoate, 4-benzylphenyl benzoate, 4-(1'-naphthyl)phenyl benzoate, 2-benzoyloxyphenyl benzoate, 4-(2'-methyl)-diphenyl benzoate, 2-phenylethyloxyphenyl benzoate, 2-acetoxyphenyl benzoate, 4-methoxyphenyl benzoate, 4-(4'-methyl)phenoxyphenyl benzoate, phenyl 4-methylbenzoate, phenyl 4-methoxybenzoate, phenyl 4-phenoxybenzoate, phenyl 4-acetoxybenzoate, 4'-methoxyphenyl 4-methoxy-benzoate, phenyl 2-acetoxybenzoate, phenyl 2-benzoyloxybenzoate, 4-methylphenyl 2-nitrobenzoate, 4-methylphenyl 4-nitrobenzoate, 4-benzoyloxybenzophenone, 2-benzoyloxy-4'-methylbenzophenone, methyl 4-benzoyloxybenzoate, ethyl 4-benzoyloxybenzoate, n-propyl 4-benzoyloxybenzoate, benzyl 4-benzoyloxybenzoate, phenyl 4-benzoyloxybenzoate, phenyl 2-benzoyloxybenzoate, ethyl 4-(4'-methylbenzoyloxy) benzoate, ethyl 4-(4'-methoxybenzoyloxy)benzoate, ethyl 4-(4'-chlorobenzoyloxy)benzoate, stearyl alcohol, melissyl alcohol, crotyl alcohol, 1,8-octadiol, 1,14-tetradecanediol, 2,5-dimethyl-3-hexene-2,5-diol, 2,4-dimethyl-2,3,4-pentatriol, pentamethyl glycerin, 1,2,3,4-pentatetrol, polyethylene glycol, monostearate, di-n-hexadecyl phenyl other, di-n-heptadecyl phenyl ether, di-n-octadecyl other, 4-methoxydiphenylamine, 4,4'-dimethoxydiphenylamine, p-benzyl-biphenyltriphenylmethane, fluorene, alkylated or hydrogenated phenanthrene or anthracene, hydrogenated alkyl phenanthrene or alkyl anthracene, N-ethylcarbazole, N-benzolylcarbazole, 4,4'-dimethoxydiphenylsulfone, 4,4'-di-n-butoxydiphenylsulfone, 4,4'-di-iso-pentyloxydiphenylsulfone, 4-iso-n-propoxy-4'-n-butoxydiphenylsulfone, 4-hydroxyphenyl-4-isopropoxyphenylsulfone, 2,4'-dihydroxydiphenylsulfone, 2,2'-diallyl-4,4'-sulfonyldiphenol, methyl-bis(4-hydroxyphenyl)acetate, N,N'-bis(3-chlorophenyl)thiourea, 2-(2'-hydroxy-5'-methylphenyl)benzotriazole, 2,2'-methylenebis(4-methyl-6-t-butylphenol), 4,4,-thiobis(3-methyl-6-t-butylphenol), phenyl hydroxy-2-naphthoate, and di(p-chlorobenzyl) oxalate.

It is preferable that the amount ratio by weight of the resin with a melting point of 120° C. or more and an SP value of 10.5 to 12.5 to the melt viscosity lowering material be in the range of 5/95 to 95/5, more preferably in the range of 30/70 to 70/30. By setting the melt viscosity at 150° C. of the thermal image transfer ink layer in the range of $1\times10^2$ to $5\times10^6$ poise by adjusting the above-mentioned amount ratio of the resin to the melt viscosity lowering material, or by adjusting the compatibiltity of the resin and the malt viscosity lowering material, measured by the transparency measurement method, to 0.20 or loss, transferred images which exhibit excellent adhesiveness to varieties of image receiving materials, excellent laundering resistance and heat resistance, can be obtained with high thermosensitivity.

The thermal image transfer ink layer for the thermal image transfer recording medium of the present invention comprises the above-mentioned resin and melt viscosity lowering material, with the addition of a coloring agent thereto. It is preferable that the deposition amount of the thermal image transfer ink layer be in the range of 0.1 to 5.0 $g/m^2$, more preferably in the range of 0.5 to 3.0 $g/m^2$ Of these coloring agents, carbon black is one of the most preferable coloring agents for use in the present invention.

It is preferable that the coloring agent for use in the present invention be not damaged by cleaning solvents such as water, warm water, 1,1,1-trichloroethane, perchlene and naphtha. Examples of such a coloring agent are carbon black and other inorganic or organic pigments.

It is preferable that the amount ratio by weight of such a coloring agent in the thermal image transfer ink layer be in the range of 5 to 70 wt. %.

It is also preferable that the amount ratio by weight of the coloring agent/the resin/the melt viscosity lowering material in the ink layer be in the range of 5–70/5–95/95–5, more preferably in the range of 10–30/30–70/70–30.

As the support for use in the thermal image transfer recording medium according to the present invention, for example, a plastic film with a thickness of about 3 to 10 $\mu$m, can be employed. Specific examples of the plastic film include polyester film, polycarbonate film, polyimide film, aromatic polyamide film, polyether ketone film, and polysulfone film.

On the back side of the support, a heat resistant film made of, for instance, silicone resin, can be provided for preventing the sticking thereto of, for instance, a thermal head.

A release layer which comprises as the main component a material with a low melting point can be interposed between the support and the thermal image transfer ink layer, whereby the image transfer performance of the thermal image transfer ink layer can be improved.

Examples of such a material with a low melting point include natural waxes such as beeswax, carnauba wax, spermaceti, Japan wax, candelilla wax, rice bran wax and montan wax; synthetic waxes such as paraffin wax, microcrystalline wax, oxidized wax, ozokerite, cersin, ester wax, polyethylene wax, and oxidized polyethylene wax. Furthermore, higher fatty acids such as margaric acid, lauric acid, myristic acid, palmitic acid, stearic acid, and behenic acid; higher alcohols such as stearyl alcohol, behenyl alcohol, melissyl alcohol, and ceryl alcohol; esters such as fatty ester of sorbitan; and amides such as stearamide and oleamide.

It is preferable that as the material having a low melting point, a material with a melting point of 110° C. or less, and with such an SP value that differs at least by 0.5 from the SP value of the support. For example, when a polyester film having an SP value of 10.7 is used as the support, it is preferable to use a material with a melting point of 110° C. or less and with an SP value of 9.5 or less, for the improvement of the image transfer performance of the thermal image transfer recording medium.

Specific examples of the material having such a low melting point include paraffin wax, microcrystalline wax, candelilla wax, carnauba wax, rice wax, montan wax, ozokerite, polyethylene wax, polyethylene oxide wax, palmitic acid, margaric acid, stearic acid, behenic acid, ceryl alcohol, and melissyl alcohol.

In order to impart elasticity to the release layer, rubbers such as isoprene rubber, butadiene rubber, ethylene propylene rubber, butyl rubber, and nitrile rubber may be added to the release layer.

Furthermore, in order to impart adhesiveness to the release layer for preventing the release layer from being peeled off the support, resins such as ethylene-vinyl acetate copolymer, and ethylene-acrylate copolymer may be added to the release layer.

It is preferable that the deposition amount of the release layer be in the range of 0. 5 to 8 g/m$^2$, more preferably in the range of 1 to 5 g/m$^2$ The release layer can be formed by hot melt coating. However, it is preferable that the components for the release layer be dispersed in a solvent to prepare a release layer formation liquid and the release layer formation liquid be coated on the support, since when the release layer is provided by this method, the shearing stress of the heat applied portions and non-heat applied portions of the thermal image transfer recording medium can be decreased, so that sharp transferred images can be produced.

As the image receiving material to which images are transferred from the thermal image transfer recording medium, paper, films and cloths can be employed.

When paper is employed, it is preferable that the paper be treated by a resin or the like so as to be resistant to water. In the case of cloths, clothe made of artificial fibers such as rayon, acetate, nylon, and polyesters natural fibers such as cotton, and silk; or mixed fabric thereof; and unwoven fabrics of theme fibers can be employed. The manner of weaving for such cloths, for example, plain weave or satin weave may be selected as desired.

In order to improve the surface smoothness of such an image receiving material or to improve the image transfer performance of the ink layer, an image receiving layer comprising as the main component a material which is insoluble in the cleaning solvents may be provided on the surface of the image receiving material.

In the case where the above-mentioned cloths are employed as image receiving materials, it is preferable that the average thickness of the air layer on the surface of such an image receiving material, to which images are transferred, measured by microtopography, be in the range of 1 to 25 $\mu$m.

When a cloth with an average air layer thickness in the range of 1 to 25 $\mu$m is employed as the image receiving material, the printing performance of the thermal image transfer recording medium of the present invention can be improved so as to obtain satisfactory image density and resolution of transferred images, without impairing the intrinsic touch or feel and appearance of the cloth.

In particular, when a cloth made of synthetic fibers is employed as the image receiving material, since the cloth itself is strong and neither worn nor cut during laundering, it is possible to integrate the thermoplastic resin in the ink layer and the fibers of the cloth serving as the image receiving material during the application of heat, so that images with excellent touch can be obtained on the cloth.

The average thickness of the air layer can be measured in accordance with the measurement method described in "An Optical Method for Evaluating Printing Smoothness of Paper", Nippon Insatsu Gakkai Ronbun-shu (Japan Printing Association Theses), 15, [4], p. 87–94 (1975), under the following measurement conditions:

Tester: Microtopograph made by Toyo Seiki Co., Ltd.

Pressure for Measurement: 13 kg/cm$^2$

Method of Measurement: Rp (Printing Roughness) is measured after 10, 20, 30, 40 and 50 msec, and Rp at 0 msec is obtained by extrapolation.

There are the following methods for adjusting the average thickness of the air layer to 1 to 25 $\mu$m: (1) adjusting the density of fibers (the degree of the density of warp and weft, indicated by the number of threads per inch), (2) adjusting the thickness of threads, (3) crushing the fibers by the application of heat and/or pressure, and (4) using soft fibers.

Other features of this invention will become apparent in the course of the following description of exemplary embodiments, which are give for illustration of the invention and are not intended to be limiting thereof.

EXAMPLE 1

Formation of Release Layer

A mixture of the following components was dispersed in a ball mill for 12 hours to prepare a release layer formation liquid:

| | Parts by Weight |
|---|---|
| Polyethylene wax (m.p. 102° C., SP value 8.0) | 10 |
| Toluene | 90 |

The thus prepared release layer formation liquid was coated on a 5 $\mu$m thick polyester film by a wire bar and dried at 50° C. for 1 minute, whereby a release layer was formed with a deposition amount of 1.5 g/m$^2$ on a dry basis on the polyester film.

Formation of Thermal Image Transfer Ink Layer

A mixture of the following components was dispersed in a ball mill for 12 hours to prepare a thermal image transfer ink layer formation liquid:

| | Parts by Weight |
|---|---|
| Nitrocellulose (m.p. 200° C., or more, SP value 10.5) | 5 |
| o,p-Toluenesulfonamide (m.p. 140° C., SP value 10.4) | 10 |
| Carbon black | 2.5 |
| Methyl ethyl ketone | 82.5 |

The thus prepared thermal image transfer ink layer formation liquid was coated on the release layer by a wire bar and dried at 50° C. for 1 minute, whereby a thermal image transfer ink layer was formed with a deposition amount of 1.0 g/m$^2$ on a dry basis on the release layer.

Formation of Heat Resistant Layer

A mixture of the following components was dispersed to prepare a heat resistant layer formation liquid:

| | Parts by Weight |
|---|---|
| Silicone-modified acrylic resin (Methyl ethyl ketone solution with 30% solid component) | 40 |
| Methyl ethyl ketone | 60 |

The thus prepared heat resistant layer formation liquid was coated on the back side of the polyester film opposite to the thermal image transfer ink layer with respect to the polyester film by a wire bar and dried at 50° C. for 1 minute, whereby a heat resistant layer was formed with a deposition amount of 0 5 g/m$^2$ on a dry basis on the back side of the polyester film.

Thus, a thermal image transfer recording medium No. 1 of the present invention was prepared.

EXAMPLE 2

The procedure for the preparation of the thermal image transfer recording medium No. 1 of the present invention in Example 1 was repeated except that the thermal image transfer ink layer formation liquid employed in Example 1 was replaced by a thermal image transfer ink layer formation liquid with the following formulation, whereby a thermal image transfer recording medium No. 2 of the present invention was prepared:

| | Parts by Weight |
|---|---|
| Polymethyl methacrylate (m.p. 125° C., SP value 11.3) | 10 |
| Carnauba wax (m.p. 85° C., SP value 8.6) | 3 |
| Carbon black | 2 |
| Methyl ethyl ketone | 85 |

EXAMPLE 3

The procedure for the preparation of the thermal image transfer recording medium No. 1 of the present invention in Example 1 was repeated except that the thermal image transfer ink layer formation liquid employed in Example 1 was replaced by a thermal image transfer ink layer formation liquid with the following formulation, whereby a thermal image transfer recording medium No. 3 of the present invention was prepared:

| | Parts by Weight |
|---|---|
| Polymethyl methacrylate (m.p. 125° C., SP value 11.3) | 10 |
| o-Chlorabenzoic acid (m.p. 142° C., SP value 12.7) | 3 |
| Carbon black | 2 |
| Methyl ethyl ketone | 85 |

EXAMPLE 4

The procedure for the preparation of the thermal image transfer recording medium No. 1 of the present invention in Example 1 was repeated except that the release layer formation liquid employed in Example 1 was replaced by a release layer formation liquid with the following formulation, whereby a thermal image transfer recording medium No. 4 of the present invention was prepared:

| | Parts by Weight |
|---|---|
| Polyamide resin (m.p. 105° C., SP value 10.2) | 10 |
| Toluene | 90 |

EXAMPLE 5

The procedure for the preparation of the thermal image transfer recording medium No. 1 of the present invention in Example 1 was repeated except that the release layer formation liquid and the thermal image transfer ink layer employed in Example 1 were respectively replaced by a release layer formation liquid and a thermal image transfer ink layer formation liquid with the following formulations, whereby a thermal image transfer recording medium No. 5 of the present invention was prepared:

[Formulation of Release Layer Formation Liquid]

| | Parts by Weight |
|---|---|
| Carnauba wax | 10 |
| Toluene | 90 |

[Formulation of Thermal Image Transfer Ink Layer Formation Liquid]

| | Parts by Weight |
|---|---|
| Nitrocellulose | 8 |
| 4-t-Butylphenol (m.p. 98° C., SP value 10.6) | 6 |
| Carbon black | 2 |
| Methyl ethyl ketone | 84 |

EXAMPLE 6

The procedure for the preparation of the thermal image transfer recording medium No. 1 of the present invention in Example 1 was repeated except that the thermal image transfer ink layer formation liquid employed in Example 1 was replaced by a thermal image transfer ink layer formation liquid with the following formulation, whereby a thermal image transfer recording medium No. 6 of the present invention was prepared:

| | Parts by Weight |
|---|---|
| Nitrocellulose | 14.5 |
| o,p-Toluenesulfonamide | 0.5 |
| Carbon black | 2.5 |
| Methyl ethyl ketone | 82.5 |

COMPARATIVE EXAMPLE 1

The procedure for the preparation of the thermal image transfer recording medium No. 1 of the present invention in Example 1 was repeated except that the thermal image transfer ink layer formation liquid employed in Example 1 was replaced by a thermal image transfer ink layer formation liquid with the following formulation, whereby a comparative thermal image transfer recording medium No. 1 was prepared:

| | Parts by Weight |
|---|---|
| Polyamide resin (m.p. 105° C., SP value 10.2) | 10 |
| o,p-Toluenesulfonamide | 5 |
| Carbon black | 2.5 |
| Methyl ethyl ketone | 82.5 |

COMPARATIVE EXAMPLE 2

The procedure for the preparation of the thermal image transfer recording medium No. 1 of the present invention in Example 1 was repeated except that the thermal image transfer ink layer formation liquid employed in Example 1 was replaced by a thermal image transfer ink layer formation liquid with the following formulation, whereby a comparative thermal image transfer recording medium No. 2 was prepared:

| | Parts by Weight |
|---|---|
| Nylon resin (m.p. 120° C., SP value 13.6) | 7.5 |
| o-Chlorobenzoic acid | 7.5 |
| Carbon black | 2.5 |
| Toluene | 50 |
| Methanol | 32.5 |

The following TABLE 2 shows the melt viscosity of each thermal image transfer ink layer, and the compatibility of the resin and the melt viscosity lowering material employed in the thermal image transfer ink layer:

TABLE 2

| | Melt Viscosity (p) at 150° C. of Ink Layer (*2) | Compatibility of Resin and Melt Viscosity Lowering Material (*1) |
|---|---|---|
| Ex. 1 | $1 \times 10^4$ | 0.06 |
| Ex. 2 | $3 \times 10^6$ | 0.15 |
| Ex. 3 | $2 \times 10^6$ | 0.10 |
| Ex. 4 | $1 \times 10^4$ | 0.06 |
| Ex. 5 | $2 \times 10^4$ | 0.06 |
| Ex. 6 | $1 \times 10^5$ | 0.06 |
| Comp. Ex. 1 | $7 \times 10^1$ | 0.06 |
| Comp. Ex. 2 | $5 \times 10^5$ | 0.06 |

*1) A mixture of a solution of the resin in the solvent (solid component 10%) and a solution of the melt viscosity lowering agent in the solvent shown in each Example was coated with a thickness of 5 μm on a dry basis on a slide glass, and dried, and the transmission density of the dried composition was measured.
*2) The melt viscosity was measured by use of a commercially available rheometer (Trademark "RDS-7700 DYNAMIC SPECTROMETER" made by Rheometrics Co., Ltd.).

By use of the above prepared thermal image transfer recording media, the image receiving materials shown in the following TABLE 3, and a thermal image transfer printer of a line type head under the application of printing energy of 10 to 29 mJ/mm$^2$, images were printed thereon and an appropriate printing energy (thermosensitivity) for each thermal image transfer recording medium was determined. Furthermore, the image density of images transferred to each image receiving material was measured and each transferred image was subjected to the following washing test by use of water to investigate the water resistance thereof, and cleaning test by use of a cleaning solvent.

The specific conditions for such tests were as follows and the results of the evaluation of the images are shown in the following TABLE 3:

(1) Water Washing Test for investigating the water-washing resistance in accordance with the Japanese Industrial Standards (JIS) L-0844 A-3.

(2) Dry Cleaning Test for investigating the dry cleaning resistance in accordance with the Japanese Industrial Standards (JIS) L-0860, by use of 1,1,1-trichloroethane as the cleaning solvent at 25° C.

The results of the above tests were evaluated in accordance with the following evaluation criteria;

⊙: No transferred images were peeled off the image receiving material.

○: Almost no transferred images were peeled off the image receiving material.

Δ: Transferred images were slightly peeled off the image receiving material.

X: Transferred images were completely peeled off the image receiving material.

TABLE 3

| Image Receiving Material | Nylon-coated Cloth | | | Polyester Satin | | | Acetate Satin | | |
|---|---|---|---|---|---|---|---|---|---|
| | Thermo-sensi-tivity (mJ/mm$^2$) | Image Density | Water Washing/ Dry Cleaning | Thermo-sensi-tivity (mJ/mm$^2$) | Image Density | Water Washing/ Dry Cleaning | Thermo-sensi-tivity (mJ/mm$^2$) | Image Density | Water Washing/ Dry Cleaning |
| Ex. 1 | 22 | 1.30 | ◎/◎ | 25 | 0.85 | ◎/◎ | 25 | 1.05 | ◎/◎ |
| Ex. 2 | 25 | 1.25 | ◎/◎ | 29 | 0.72 | ○/○ | 29 | 0.82 | ○/○ |
| Ex. 3 | 25 | 1.28 | ◎/◎ | 28 | 0.74 | ○/◎ | 28 | 0.85 | ○/◎ |
| Ex. 4 | 25 | 1.30 | ◎/◎ | 28 | 0.79 | ○/◎ | 28 | 0.95 | ○/◎ |
| Ex. 5 | 22 | 1.31 | ◎/◎ | 25 | 0.64 | ◎/◎ | 25 | 1.04 | ◎/◎ |
| Ex. 6 | 21 | 1.31 | ◎/◎ | 30 | 0.70 | ◎/◎ | 30 | 0.73 | ◎/◎ |
| Comp. Ex. 1 | 20 | 1.34 | ◎/◎ | 22 | 0.62 | X/X | 22 | 0.63 | X/X |
| Comp. Ex. 2 | 24 | 1.34 | ◎/◎ | 29 | 0.62 | Δ/Δ | 29 | 0.63 | Δ/Δ |

By use of the above prepared thermal image transfer recording media, thermal printing was performed an a polypropylene film, a polyester film and a nylon film by the previously mentioned thermal imago transfer printer and an appropriate printing energy (thermosensitivity) for each thermal image transfer recording medium was determined. The images transferred to each image receiving material was subjected to a scratching durability test by scratching the transferred images with a tip of a sharp pencil 10 times, and to an ironing resistance test by rubbing the transferred images with an iron heated to 130° C. The results of the evaluation of the images subjected to these tests are shown in the following TABLE 4:

The results of the above tests were evaluated in accordance with the following evaluation criteria:

◎: No transferred images were peeled off the image receiving material.

○: Almost no transferred images were peeled off the image receiving material.

Δ: Transferred images were slightly peeled off the image receiving material.

X: Transferred images were completely peeled off the image receiving material.

When the resin with a melting point of 120° C. or more and an SP value of 10.5 to 12.5 and the melt viscosity lowering material with good compatibility with the resin are used in combination as the components for the thermal image transfer ink layer, the ink layer is melted sharply with high thermosensitivity when heated imagewise and can be transferred imagewise to various kinds of image receiving material s and firmly adhere thereto, whereby transferred images with high scratching durability, high laundering resistance and high heat resistance, can be obtained.

When the melt viscosity at 150° C. of the thermal image transfer ink layer is adjusted so as to fall in the range of $1\times10^2$ to $5\times10^6$ poise, transferred images with high heat resistance, scratching durability and laundering resistance can be obtained with particularly high thermosensitivity.

EXAMPLES 7 to 19

A release layer formation liquid with the following formulation was coated on a 4.5 μm thick polyester film, and dried, whereby a release layer with a deposition amount of about 1 g/m$^2$ on a dry basis was formed on the polyester film:

TABLE 4

| Image Receiving Material | Polypropylene Film | | | Polyester Film | | | Nylon Film | | |
|---|---|---|---|---|---|---|---|---|---|
| | Termo-sensi-tivity (mJ/mm$^2$) | Image Density | Scrating Durability/ Ironing Resistance | Termo-sensi-tivity (mJ/mm$^2$) | Image Density | Scrating Durability/ Ironing Resistance | Termo-sensi-tivity (mJ/mm$^2$) | Image Density | Scrating Durability/ Ironing Resistance |
| Ex. 1 | 17 | 2.05 | ◎/○ | 15 | 2.05 | ◎/◎ | 15 | 2.04 | ◎/◎ |
| Ex. 2 | 20 | 2.06 | Δ/○ | 18 | 2.03 | ○/◎ | 18 | 2.05 | ○/◎ |
| Ex. 3 | 19 | 2.04 | Δ/○ | 17 | 2.01 | ◎/◎ | 17 | 2.00 | ◎/◎ |
| Ex. 4 | 20 | 2.04 | Δ/○ | 18 | 2.00 | ○/◎ | 18 | 2.00 | ◎/◎ |
| Ex. 5 | 18 | 2.03 | ◎/○ | 16 | 2.01 | ◎/◎ | 16 | 2.00 | ◎/◎ |
| Ex. 6 | 22 | 2.04 | ◎/◎ | 21 | 2.00 | ◎/◎ | 21 | 2.03 | ◎/◎ |
| Comp. Ex. 1 | 19 | 2.00 | X/X | 18 | 1.99 | ○/X | 14 | 2.04 | ◎/X |
| Comp. Ex. 2 | — | Not Trans-ferred | — | 19 | 1.99 | X/◎ | 18 | 2.02 | ◎/◎ |

[Formulation of Release Layer Formation Liquid]

| | Parts by Weight |
|---|---|
| Paraffin wax | 9 |
| Ethylene - vinyl acetate copolymer resin | 1 |
| Toluene | 90 |

A thermal image transfer ink layer formation liquid with the following formulation was coated on the release layer, or directly on the polyester film, and dried, whereby a thermal image transfer ink layer was deposited on the release layer or on the polyester film, with a deposition amount of about 1 g/m$^2$, whereby thermal image transfer recording media Nos. 7–19 of the present invention were prepared:

[Formulation of Thermal Transfer Ink Layer Formation Liquid]

| | Parts by Weight |
|---|---|
| Carbon black | 22.5 |
| Nitrocellulose | 63.75 |
| Melt viscosity lowering material (refer to TABLE 5) | 63.75 |
| Methyl ethyl ketone | 850 |

TABLE 5

| | Melt Viscosity Lowering Material | | | Melt Viscosity at 150° C. of Ink Layer | Compatibility of Resin and Melt Viscosity Lowering | Release |
|---|---|---|---|---|---|---|
| | A | B | A/B | (*2) | Material (*1) | Layer |
| Ex. 7 | DMP (dimethyl phthalate) | None | — | 500–2000 | 0.06 | Provided |
| Ex. 8 | DBP (dibutyl phthalate) | | | 500–2000 | 0.06 | Provided |
| Ex. 9 | DOA (dioctyl adipate) | | | 500–2000 | 0.06 | Provided |
| Ex. 10 | o-TSA (orthotoluene sulfonamide) | p-TSA | 60/40 | 500–2000 | 0.06 | Provided |
| Ex. 11 | o-TSA (orthotoluene sulfonamide) | None | — | 500–2000 | 0.06 | Not Provided |
| Ex. 12 | p-TSA | | | 500–2000 | 0.06 | Provided |
| Ex. 13 | epoxidized soybean oil | | | 500–2000 | 0.06 | Provided |
| Ex. 14 | PEG (molecular weight = 1000) | | | 500–2000 | 0.06 | Provided |
| Ex. 15 | TPP (triphenyl phosphate) | | | 500–2000 | 0.06 | Provided |
| Ex. 16 | bisphenol F | | | 500–2000 | 0.06 | Provided |
| Ex. 17 | o-TSA | DKP | 80/20 | 500–2000 | 0.06 | Provided |
| Ex. 18 | o-TSA | polyester | 80/20 | 500–2000 | 0.06 | Provided |
| Ex. 19 | o-TSA | p-TSA | 80/20 | 500–2000 | 0.06 | Provided |

*1) A mixture of a solution of the resin in the solvent (solid component 10%) and a solutian of the melt viscosity lowering agent in the solvent shown in each Example was coated with a thickness of 5 $\mu$m on a dry basis on a slide glass, and dried, and the transmission density of the dried composition was measured.
*2) The melt viscosity was measured by use of a commercially available rheometer (Trademark "RDS-70700 DYNAMIC SPECTROMETER" made by Rheometrics Co., Ltd.).

COMPARATIVE EXAMPLE 3

The procedure for the preparation of the thermal image transfer recording medium No. 7 of the present invention in Example 7 was repeated except that the thermal image transfer ink layer formation liquid employed in Example 7 was replaced by a thermal image transfer formation liquid with the following formulation, whereby a comparative thermal image transfer recording medium No. 3 was prepared:

| | Parts by Weight |
|---|---|
| Carbon black | 22.5 |
| Nitrocellulose | 127.5 |
| Methyl ethyl ketone | 650 |

COMPARATIVE EXAMPLE 4

The procedure for the preparation of the thermal image transfer recording medium No. 7 of the present invention in Example 7 was repeated except that the thermal image transfer ink layer formation liquid employed in Example 7 was replaced by a thermal image transfer ink layer formation liquid with the following formulation, whereby a comparative thermal image transfer recording medium No. 4 was prepared:

| | Parts by Weight |
|---|---|
| Carbon black | 22.5 |
| Oxidized polyethylene wax | 127.5 |
| Methyl ethyl ketone | 850 |

COMPARATIVE EXAMPLE 5

The procedure for the preparation of the thermal image transfer recording medium No 7 of the present invention in Example 7 was repeated except that the thermal image transfer ink layer formation liquid employed in Example 7 was replaced by a thermal image transfer ink layer formation liquid with the following formulation, whereby a comparative thermal image transfer recording medium No. 5 was prepared:

| | Parts by Weight |
|---|---|
| Carbon black | 22.5 |
| Nylon copolymer | 127.5 |
| Methanol | 850 |

COMPARATIVE EXAMPLE 6

The procedure for the preparation of the thermal image transfer recording medium No. 7 of the present invention in Example 7 was repeated except that the thermal image transfer ink layer formation liquid employed in Example 7 was replaced by a thermal image transfer ink layer formation liquid with the following formulation, whereby a comparative thermal image transfer recording medium No. 6 was prepared:

| | Parts by Weight |
|---|---|
| Carbon black | 22.5 |
| Acrylic copolymer | 127.5 |
| Methyl ethyl ketone | 850 |

COMPARATIVE EXAMPLE 7

The procedure for the preparation of the thermal image transfer recording medium No. 7 of the present invention in Example 7 was repeated except that the thermal image transfer ink layer formation liquid employed in Example 7 was replaced by a thermal image transfer ink layer formation liquid with the following formulation, whereby a comparative thermal image transfer recording medium No. 7 was prepared:

| | Parts by Weight |
|---|---|
| Carbon black | 22.5 |
| Nitrocellulose | 12.75 |
| p-TSA | 114.75 |
| Methyl ethyl ketone | 850 |

TABLE 6

| | Melt Viscosity at 150° C. of Ink Layer (*2) | Compatibility of Resin and Melt Viscosity Lowering Material (*1) | Release Layer |
|---|---|---|---|
| Comp. Ex. 3 | $10^6$ poise< | — | Provided |
| Comp. Ex. 4 | $10^2$ poise> | — | Provided |
| Comp. Ex. 5 | $10^6$ poise | — | Provided |
| Comp. Ex. 6 | $10^3$ poise | — | Provided |
| Comp. Ex. 7 | 30 poise | — | Provided |

(*1) A mixture of a solution of the resin in the solvent (solid component 10%) and a solution of the melt viscosity lowering agent in the solvent shown in each Example was coated with a thickness of 5 μm on a dry basis on a slide glass, and dried, and the transmission density of the dried compostion was measured.
(*2) The melt viscosity was measured by use of a commercially available rheometer (Trademark "RDS-70700 DYNAMIC SPECTROMETER" made by Rheometrics Co., Ltd.).

By use of the above prepared thermal image transfer recording media, the image receiving materials shown in the following TABLE 7, and a thermal image transfer printer of a line type head under the application of printing energy of 10 to 29 mJ/mm$^2$, bar code images were printed thereon and an appropriate printing energy (thermosensitivity) for each thermal image transfer recording medium was determined. Furthermore, the image density of the bar code images transferred to each image receiving material was measured, and the bar code images were subjected to the following washing test by use of water to investigate the water-washing resistance thereof, and cleaning test by use of a cleaning solvent. The specific conditions for such tests were as follows, and the results of the evaluation of the images are shown in the following TABLE 7:

(1) Water Washing Test for investigating the water-washing resistance in accordance with the Japanese Industrial Standards (JIS) L-0844 A-3.

(2) Dry Cleaning Test for investigating the dry cleaning resistance in accordance with the Japanese Industrial Standards (JIS) L-0960, by use of 1,1,1-trichloroethane as the cleaning solvent at 25° C.

The results of the above tests were evaluated in accordance with the following evaluation criteria:

⊙: No transferred images were peeled off the image receiving material.

○: Almost no transferred images were peeled off the image receiving material.

Δ: Transferred images were slightly peeled off the image receiving material.

X: Transferred images were completely peeled off the image receiving material.

In addition, the resolution of each transferred bar code image was visually inspected to see if dots in bar codes in the transverse direction were clearly separated or not.

Furthermore, the presence or absence of the blooming phenomenon was also visually inspected after each thermal imago transfer recording m-dium was preserved at 50° C. for 24 hours.

The results of the above tests are shown in the following TABLE 7:

TABLE 7

| Image Receiving Material | Nylon-coated Cloth | | | | Polyester Satin | | | | Acetate Satin | | | | Blooming Phenomenon (*2) |
|---|---|---|---|---|---|---|---|---|---|---|---|---|---|
| | Thermo-sensi-tivity (mJ/mm$^2$) | Image Density | Water Washing/ Dry Cleaning | Re-solu-tion (*1) | Thermo-sensi-tivity (mJ/mm$^2$) | Image Density | Water Washing/ Dry Cleaning | Re-solu-tion (*1) | Thermo-sensi-tivity (mJ/mm$^2$) | Image Density | Water Washing/ Dry Cleaning | Re-solu-tion (*1) | |
| Ex. 7 | 23 | 1.39 | ◎/◎ | B | 29 | 0.63 | ◎/◎ | B | 29 | 1.02 | ◎/◎ | B | A |
| Ex. 8 | 20 | 1.31 | ◎/◎ | B | 26 | 0.76 | ◎/◎ | B | 26 | 1.07 | ◎/◎ | B | A |
| Ex. 9 | 23 | 1.20 | ◎/◎ | B | 29 | 0.32 | ○/○ | B | 29 | 0.71 | ○/○ | B | A |
| Ex. 10 | 23 | 1.28 | ◎/◎ | B | 26 | 0.61 | ◎/◎ | A | 26 | 0.95 | ◎/◎ | A | B |
| Ex. 11 | 26 | 0.90 | ◎/◎ | A | 29 | 0.55 | ◎/◎ | A | 29 | 0.69 | ◎/◎ | A | C |
| Ex. 12 | 23 | 1.20 | ◎/◎ | A | 26 | 0.68 | ◎/◎ | A | 26 | 0.98 | ◎/◎ | A | A |
| Ex. 13 | 23 | 1.35 | ◎/◎ | A | 29 | 0.77 | ◎/◎ | B | 29 | 1.0 | ◎/◎ | B | A |
| Ex. 14 | 23 | 1.46 | ◎/◎ | B | 29 | 0.72 | ◎/◎ | B | 29 | 1.06 | ◎/◎ | B | A |
| Ex. 15 | 20 | 1.33 | ◎/◎ | B | 26 | 0.72 | ◎/◎ | B | 26 | 1.0 | ◎/◎ | B | A |
| Ex. 16 | 23 | 1.27 | ◎/◎ | B | 29 | 0.54 | ○/○ | B | 29 | 0.89 | ○/○ | B | A |
| Ex. 17 | 23 | 1.23 | ◎/◎ | B | 26 | 0.66 | ◎/◎ | B | 26 | 0.93 | ◎/◎ | B | B |
| Ex. 18 | 23 | 1.25 | ◎/◎ | B | 26 | 0.67 | ◎/◎ | B | 26 | 0.93 | ◎/◎ | B | B |
| Ex. 19 | 23 | 1.28 | ◎/◎ | A | 26 | 0.69 | ◎/◎ | A | 26 | 0.95 | ◎/◎ | A | A |
| Comp. Ex. 3 | 26 | 1.15 | ◎/◎ | A | 29 | 0.34 | ◎/◎ | A | 29 | 0.34 | ◎/◎ | A | A |
| Comp. Ex. 4 | 20 | 1.26 | Δ/Δ | B | 26 | 0.78 | Δ/Δ | B | 26 | 0.73 | X/X | B | A |
| Comp. Ex. 5 | 20 | 1.9 | ○/○ | B | 29 | 0.83 | Δ/○ | B | 29 | 1.03 | X/X | B | A |
| Comp. Ex. 6 | 26 | 1.57 | X/X | A | 29 | 0.40 | X/X | B | 29 | 1.0 | X/X | B | A |
| Comp. Ex. 7 | 20 | 1.25 | Δ/Δ | A | 23 | 0.65 | Δ/Δ | A | 23 | 0.98 | Δ/Δ | A | C |

*1) "A" denotes that dots were clearly separated: and "B" donates that dots were not clearly separated.
*2) "A" denotes that the blooming phenomenon was not observed: "B" denotes that the blooming phenomenon was slightly observed; and "C" denotes that the blooming phenomenon was clearly observed.

EXAMPLE 20

A release layer formation liquid with the following formulation was coated on a 4.5 μm thick polyester film, and dried, whereby a release layer with a deposition amount of about 1 g/m$^2$ on a dry basis was formed on the polyester film:

[Formulation of Release Layer Formation Liquid]

| | Parts by Weight |
|---|---|
| Paraffin wax | 9 |
| Ethylene - vinyl acetate copolymer resin | 1 |
| Toluene | 90 |

A thermal image transfer ink layer formation liquid with the following formulation was coated on the release layer on the polyester film, and dried, whereby a thermal image transfer ink layer was formed on the release layer with a deposition amount of about 1 g/m$^2$ on a dry basis.

[Formulation of Thermal Transfer Ink Layer Formation Liquid]

| | Parts by Weight |
|---|---|
| Carbon black | 3 |
| Nitrocelluloue | 6 |
| o-Toluenesulfonamide | 6 |
| Methyl ethyl ketone | 85 |

Thus, a thermal image transfer recording medium No. 20 of the present invention was prepared.

By use of the above prepared thermal image transfer recording medium No. 20, a variety of image receiving materials made of different materials, with different average air layer thicknesses, as shown in the following TABLE 8, and a thermal image transfer printer of a line type head under the application of printing energy of 10 to 29 mJ/mm$^2$, images were printed thereon and the image densities of images transferred to each image receiving material were measured. Furthermore, each transferred image was subjected to the following washing test by use of water to investigate the water-washing resistance thereof, and cleaning test by use of a cleaning solvent. The specific conditions for such tests were as follows and the results of the evaluation of the images are shown in the following TABLE 8:

(1) water Washing Test for investigating the water resistance in accordance with the Japanese Industrial Standards (JIS) L-0844 A-3.

(2) Dry Cleaning Teat for investigating the dry cleaning resistance in accordance with the Japanese Industrial Standards (JIS) L-0860, by use of 1,1,1-trichloroethane as the cleaning solvent at 25° C.

The results of the above tests were evaluated in accordance with the following evaluation criteria:

◎: No transferred images were peeled off the image receiving material.

○: Almost no transferred images were peeled off the image receiving material.

Δ: Transferred images were slightly peeled off the image receiving material.

X: Transferred images were completely peeled off the image receiving material.

TABLE 8

| | Image Receiving Materials | | | | Proparties of Transferred Images | | |
|---|---|---|---|---|---|---|---|
| | Material | Treatment | Average Air Layer Thickness (Rp)(μm) | Touch or Feel | Image Density | Water Washing Resistance | Dry Cleaning Resistance |
| Test Ex. 1 | cotton | None | 20 | Good | 0.7 | ○ | ○ |
| Test Ex. 2 | polyester | Calendered | 20 | Good | 0.8 | ◎ | ◎ |
| Test EX. 3 | nylon | Calendered | 15 | Good | 1.2 | ◎ | ◎ |
| Test Ex. 4 | acetate | Calendered | 13 | Good | 1.2 | ◎ | ◎ |
| Test Ex. 5 | polyester | Calendered | 20 | Good | 0.8 | ◎ | ◎ |
| Test Ex. 6 | nylon | Calendered | 15 | Good | 1.5 | ◎ | ◎ |
| Test Ex. 7 | acetate | Calendered | 13 | Good | 1.0 | ◎ | ◎ |
| Test Ex. 8 | acryl | Calendered | 20 | Good | 0.8 | ○ | ○ |
| Comp. Test Ex. 1 | cotton | None | 30 | Good | 0.5 | Δ | Δ |
| Comp. Test Ex. 2 | polyester | None | 30 | Good | 0.6 | ○ | ○ |
| Comp. Test Ex. 3 | nylon | None | 28 | Good | 0.9 | ○ | ○ |
| Comp. Test Ex. 4 | acetate | None | 26 | Good | 0.9 | ○ | ○ |
| Comp. Test Ex. 5 | nylon | Nylon-coated | 0.7 | No Good | 1.4 | ◎ | ◎ |

The test results shown in the above TABLE 8 indicate that by setting the average thickness of the air layer on the surface of the cloth serving as the image receiving material in the range of 1 to 25 μm, the contact area between the ink layer of the thermal image transfer recording medium and the surface of the cloth serving as image receiving material can be increased, so that the image density and resolution obtained can be improved.

Furthermore, by setting the average thickness of the air layer am mentioned above, the intrinsic touch or feel and appearance of the image receiving material can be maintained.

According to the present invention, by use of a resin with a malting point of 120° C. or more and an SP value of 10.5 to 12.5, and a malt viscosity lowering material for lowering the melt viscosity of the resin, which exhibits good compatibility of the resin in the ink layer of the thermal image transfer recording medium of the present invention, and also by setting the melt viscosity at 150° C. of the ink layer in the range of $1\times10^2$ to $5\times10^8$ poise, not only the adhesiveness of images transferred from the thermal image transfer ink layer to a variety of image receiving materials, but also the laundering resistance, scratching resistance and heat resistance of the transferred images can be improved, and such images can be formed with high resolution and high thermosensitivity.

What is claimed is:

1. A thermal transfer recording medium, comprising:

a) a support, b) a thermal transfer ink layer formed directly on said support, said thermal transfer ink layer comprising a coloring agent, nitrocellulose resin with a melting point of 120° C. or more and an SP value of 10.5–12.5 and a plasticizer for lowering the melt viscosity of said resin, said plasticizer having a melting point of 80–200° C. and a molecular weight of 1000 or less, with the melt viscosity of 150° C. of said thermal transfer ink layer being in the range of $1\times10^2$ to $5\times10^5$ poise; and wherein said plasticizer is selected from the group consisting of phthalic acid plasticizers, sulfonic acid plasticizers, epoxy plasticizers, glycol plasticizers, and phosphoric acid plasticizers.

2. The thermal image transfer recording medium as claimed in claim 1, wherein the amount ratio by weight of said resin to said plasticizer is in the range of 5/95–95/5.

3. The thermal image transfer recording medium as claimed in claim 1, wherein the amount ratio by weight of said resin to said plasticizer is in the range of 30/70–70/30.

4. The thermal image transfer recording medium as claimed in claim 3, wherein said plasticizer is a phthalic acid plasticizer selected from the group consisting of DMP, DBP, dioctyl phthalate, diiosononyl phthalate and diphenyl phthalate.

5. The thermal image transfer recording medium as claimed in claim 1, wherein said plasticizer is a sulfonic acid plasticizer, which is a compound of the formula (I) or (II):

(I)

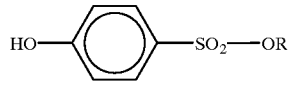

(II)

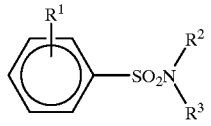

wherein for either, R is $(CH_3)_2CH$—;

$R^1$ is selected from the group consisting of p-$CH_3$, o-$CH_3$ and o-$C_2H_5$; $R^2$ is selected from the group consisting of hydrogen, methyl, ethyl isopropyl, cyclohexyl and phenyl; and $R^3$ is selected from the group consisting of H and $CH_3$.

6. The thermal image transfer recording medium as claimed in claim 1, wherein said plasticizer is an epoxy-based plasticizer selected from the group consisting of epoxidized soybean oil, epoxidized linseed oil, alkyl epoxy stearate and epoxidized fatty acid esters.

7. The thermal image transfer recording medium as claimed in claim 1, wherein said plasticizer is polyethylene glycol.

8. The thermal image transfer recording medium as claimed in claim 1, wherein said plasticizer is a phosphonic acid plasticizer selected from the group consisting of trioctyl phosphate, triphenyl phosphate, trioctyl phosphate, triphenyl phosphate, tricresyl phosphate, cresyl diphenyl phosphate and xylenyl diphenyl phosphate.

* * * * *

UNITED STATES PATENT AND TRADEMARK OFFICE

CERTIFICATE OF CORRECTION

PATENT NO. : 6,117,562 B1
DATED : September 12, 2000
INVENTOR(S) : Junko Yamaguchi et al.

It is certified that error appears in the above-identified patent and that said Letters Patent is hereby corrected as shown below:

Title page,
Item [57] ABSTRACT,
Line 1, "sodium" should read -- medium --;
Line 7, "malt" should read -- melt --.

Column 1,
Line 39, "Por" should read -- For --.

Column 3,
Line 22, "imago" should read -- image --;
Line 36, "transmission#" should read -- transmission, --;
Line 42, "Into" should read -- into --;
Lines 49 and 51, "malt" should read -- melt --;

Column 4,
Line 3, "malting" should read -- melting --;
Line 57, "polyfunctional type, type, and" should read -- polyfunctional type, and --;
Line 58, "acid; and" should read -- acid, and --;
Line 59, "malt" should read -- melt --;

Column 5,
TABLE 1, the entire line 32, "$^{-}$ o-$CH_3$ H H 107-110" should read -- $^{-}$ o-$C_2H_5$ H H 107-110 --.

Column 6,
Line 2, "amorphous, state. As much" should read -- amorphous state. As such --;
Line 27, "others" should read -- ethers --;
Line 29, "derivative.," should read -- derivatives, --;
Line 32, '4-tort-butylphenol (98)" should read -- 4-tert-butylphenol --;
Line 41, "(2-tort" should read -- (2-tert --;
Line 64, "(129)" should read -- (128) --.

Column 8,
Line 15, "other," should read -- ether, --;
Line 16, "other," should read -- ether --;
Line 29, "4,4,-thiobis(3-" should read -- 4,4'-thiobis(3- --;
Line 40, "malt" should read -- melt --;
Line 42, "loss," should read -- less, --.

UNITED STATES PATENT AND TRADEMARK OFFICE

CERTIFICATE OF CORRECTION

PATENT NO. : 6,117,562 B1
DATED : September 12, 2000
INVENTOR(S) : Junko Yamaguchi et al.

It is certified that error appears in the above-identified patent and that said Letters Patent is hereby corrected as shown below:

Columns 15 and 16, TABLE 3,
"Ex. 5", in the column "Polyester Satin", in the column "Image Density", 6th column from left margin, "0.64" should read -- 0.84 --;
"Ex. 6", in the column "Nylon-coated Cloth", in the column "Thermosensitivity ($mJ/mm^2$", 2nd column from left margin, "21" should read -- 27 --.

Column 15,
Line 27, "imago" should read -- image --.

Column 16,
Line 27, "material s and" should read -- materials and --.

Columns 15 and 16, TABLE 4,
In three column headings (three occurrences), "Termosensitivity" should read -- Thermosensitivity --;
In three column headings (three occurrences), "Scrating" should read -- Scratching --;
"Ex. 1 Comp.", in the column "Polyester Film" in the column "Scratching Durability/ Ironing Resistance", 7th column from left margin, "X/⊙" should read -- X/O --.

Columns 17 and 18, TABLE 5,
"Ex. 17", in the column "Melt Viscosity Lowering Material", in the column "B", 3rd column from left margin, "DKP" should read -- DMP --.

Column 23,
Line 36, "am" should read -- as --;
Line 40, "malting" should read -- melting --;
Line 41, "malt" should read -- melt --;
Line 46, "$5x10^8$" should read -- $5x10^6$ --.

UNITED STATES PATENT AND TRADEMARK OFFICE

CERTIFICATE OF CORRECTION

PATENT NO. : 6,117,562 B1
DATED : September 12, 2000
INVENTOR(S) : Junko Yamaguchi et al.

It is certified that error appears in the above-identified patent and that said Letters Patent is hereby corrected as shown below:

Column 26,
Lines 4 and 5, "phosphate, triphenyl phosphate, trioctyl phosphate, triphenyl phosphate, tricresyl" should read -- phospate, triphenyl phosphate, tricresyl --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*